United States Patent [19]

Dragone

[11] 4,425,566

[45] Jan. 10, 1984

[54] ANTENNA ARRANGEMENT FOR PROVIDING A FREQUENCY INDEPENDENT FIELD DISTRIBUTION WITH A SMALL FEEDHORN

[75] Inventor: Corrado Dragone, Little Silver, N.J.

[73] Assignee: Bell Telephone Laboratories, Incorporated, Murray Hill, N.J.

[21] Appl. No.: 297,842

[22] Filed: Aug. 31, 1981

[51] Int. Cl.[3] ..... H01Q 19/19

[52] U.S. Cl. ..... 343/781 P; 343/840

[58] Field of Search ..... 343/781 P, 781 CA, 840

[56] References Cited

U.S. PATENT DOCUMENTS

| | | | |
|---|---|---|---|
| 3,414,904 | 12/1968 | Ajioka | 343/781 |
| 3,936,837 | 2/1976 | Coleman et al. | 343/781 |
| 3,949,404 | 4/1976 | Fletcher et al. | 343/761 |
| 4,203,105 | 5/1980 | Dragone et al. | 343/781 |
| 4,223,316 | 9/1980 | Drabowitch | 343/781 |
| 4,259,674 | 3/1981 | Dragone et al. | 343/909 |

OTHER PUBLICATIONS

Dragone et al.; Imaging Reflector . . . Small Array; BSTJ, vol. 58, No. 2, Feb. 1979, pp. 501–515.

Dragone et al.; Satellite Phased Array . . . To Reduce Grating Lobes; BSTJ, vol. 59, No. 3; Mar. 1980; pp. 449–461.

*Primary Examiner*—Eli Lieberman

*Attorney, Agent, or Firm*—Erwin W. Pfeifle

[57] ABSTRACT

The present invention relates to an antenna arrangement which uses an imaging reflector (10) combined with a small feed or horn (14) which is capable of launching or receiving a spherical wavefront (18) to obtain a nearly frequency independent field distribution over a large antenna aperture. The antenna arrangement comprises a parabolic main reflector (10) disposed confocally with one focal point of a subreflector means (12) and a feed (14) disposed with the apex of the spherical wavefront at the other focal point of the subreflector means and the aperture of the feed centered on the image of the main reflector. If the rim of the feed aperture corresponds to an image of the edge of the main reflector, spill-over is substantially eliminated. Generally, any feed arrangement comprising a feed and subreflector means which transforms a spherical wavefront from the feed into a spherical wavefront emanating from the focal point of the parabolic main reflector can be used.

5 Claims, 6 Drawing Figures

ANTENNA ARRANGEMENT FOR PROVIDING A FREQUENCY INDEPENDENT FIELD DISTRIBUTION WITH A SMALL FEEDHORN

BACKGROUND OF THE INVENTION

1. Field of the Invention

The present invention relates to an antenna arrangement for providing a nearly frequency independent field distribution using a small feedhorn and, more particularly, to an antenna arrangement which uses a main reflector combined with a feed arrangement comprising an imaging ellipsoid subreflector, confocally disposed at a first focus with the main reflector, and a small feedhorn disposed such that both the apex of a spherical wavefront launched therefrom is positioned at the other focus of the subreflector and the surface and boundary of the aperture of the feedhorn are substantially at the image surface and boundary, respectively, of the main reflector.

2. Description of the Prior Art

When the far-field of a horn is used to illuminate the aperture of a paraboloid, the resulting distribution varies with frequency. This variation, which is due to the phase-center and beam-width frequency-dependence of the horn has been an important limitation in the past and has been described in, for example, the article "An Improved Antenna For Microwave Radio System Consisting of Two Cylindrical Reflectors and a Corrugated Horn" by C. Dragone in *BSTJ*, Vol. 53, No. 7, September 1974 at pages 1351–1377. A simple way to realize a frequency independent illumination over a large aperture is to use a very long horn so as to guide a spherical wavefront from the apex of the horn to the antenna aperture. In this regard see, for example, U.S. Pat. No. 3,936,837 issued to H. P. Coleman et al on Feb. 3, 1976 and U.S. Pat. No. 3,949,404 issued to J. C. Fletcher et al on Apr. 6, 1976. Such long horns, however, are expensive and heavy.

The problem remaining in the prior art is to provide an antenna arrangement which has a nearly frequency independent field distribution over a large antenna aperture with minimal spill-over which doesn't use long feedhorns.

SUMMARY OF THE INVENTION

The foregoing problem in the prior art has been solved in accordance with the present invention which relates to an antenna arrangement for providing a nearly frequency independent field distribution using a small feedhorn and, more particularly, to an antenna arrangement which uses a main reflector combined with a feed arrangement comprising an imaging ellipsoid subreflector, confocally disposed at a first focus with the main reflector, and a small feedhorn disposed such that both the apex of a spherical wavefront launched therefrom is positioned at the other focus of the subreflector and the surface and boundary of the aperture of the feedhorn are substantially at the image surface and boundary, respectively, of the main reflector.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
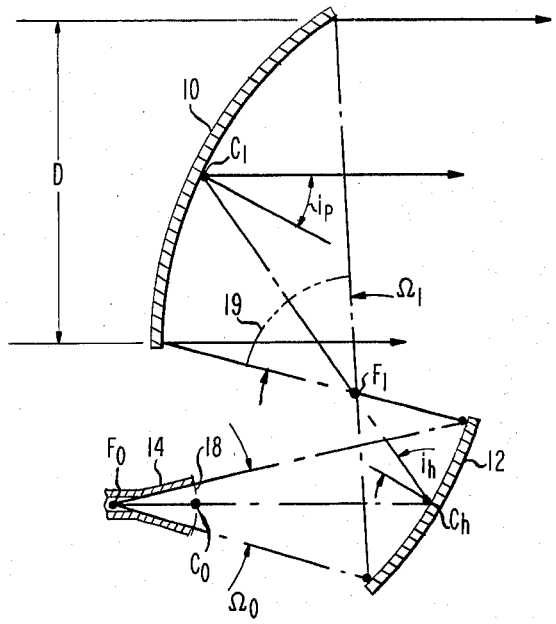
FIG. 1 illustrates a cross-sectional side-view of an antenna arrangement in accordance with the present invention.

FIG. 1 illustrates an antenna arrangement for providing a frequency independent field distribution in accordance with the present invention comprising a paraboloid main reflector 10, an ellipsoid subreflector 12 and a feedhorn 14. Paraboloid main reflector 10 is shown as having a predetermined aperture diameter D, a central point on the reflecting surface designated $C_1$, and a focal point $F_1$. Ellipsoid subreflector 12 is shown as comprising a first focal point $F_1$ disposed confocally with the focal point $F_1$ of main reflector 10, a second focal point $F_0$ disposed at the apex of a spherical wavefront 18 launched by feedhorn 14, and a central point on the reflecting surface designated $C_h$. Small feedhorn 14 can comprise any suitable feedhorn as, for example, a corrugated or non-corrugated horn known in the art which has dimensions that can dispose the central point, designated $C_0$, of its aperture at substantially the conjugate point or image of central point $C_1$ on main reflector 10, and its apex at the focal point $F_0$ of subreflector 12. Such condition implies that the field distribution in the vicinity of point $C_1$ is the image of the field in the vicinity of point $C_0$ in the aperture of feedhorn 14. As will be described in greater detail hereinafter, in accordance with the present invention it is also preferred that the edge of the main reflector 10 be substantially the image of the edge of the feedhorn aperture.

In operation, the aperture of feedhorn 14 is centered at point $C_0$ and imaging subreflector 12 transforms the aperture illumination in the vicinity of point $C_0$ into a magnified image appearing in the vicinity of the conjugate point $C_1$ on main reflector 10 whose location can be specified by the well known lens equation (1) discussed hereinafter. A property of this image is that it is essentially frequency-independent, since it can be determined as follows using the laws of geometric optics. Since the field distribution around point $C_0$ in the aperture of feedhorn 14 is a spherical wavefront 18 originating from focal point $F_0$, the corresponding image around point $C_1$ of main reflector 10 is a spherical wavefront 19 originating from focal point $F_1$ of both main reflector 10 and subreflector 12. It is to be understood that focal point $F_1$ is the conjugate point of the other focal point $F_0$ of ellipsoid subreflector 12 and that it coincides with the apex of spherical wavefront 18.

Thus, the image is approximately the field distribution that one would obtain with a long horn with an aperture centered at point $C_1$ and an apex at point $F_1$ and in effect a small feedhorn 14 has been transformed into a much larger horn.

The aperture distribution at point $C_0$ of feedhorn 14 will be a good reproduction of the distribution at point $C_1$ at main reflector 10 provided the aperture of the ellipsoid subreflector 12 is large enough so that essentially all of the energy radiated by feedhorn 14 is intercepted by ellipsoid subreflector 12.

By choosing the paraboloid main reflector 10 dimensions so that these dimensions correspond to the image of the aperture of feedhorn 14, a good aperture efficiency can be obtained. If, for instance, feedhorn 14 has a circular aperture of diameter $D_0$, then the diameter of the paraboloid of main reflector 10 must be chosen to equal $M_aD_0$, where $M_a$ is the image magnification. Since points $C_0$ and $C_1$ are conjugate points, their distances $l_0$ and $l_1$ from the center point $C_h$ of ellipsoid subreflector 12 must satisfy the lens equation $$(1/l_0)+(1/l_1)=(1/f_h), \tag{1}$$

where $f_h$ is the focal length of the ellipsoid of subreflector 12 and can be determined from $$1/f_h=(1/|F_0C_h|)+(1/|C_hF_1|). \tag{2}$$

The magnification $M_a$ can be determined by $$M_a=l_1/l_0. \tag{3}$$

In general, the use of one or more reflectors with nonzero angles of incidence, as in FIG. 1, gives rise to depolarization resulting in cross-polarized components appearing over the antenna aperture. These cross-polarized components can be substantially reduced in the arrangement of FIG. 1 by requiring the following condition. The angles of incidence $i_h$ and $i_p$ and the magnification $$M=-|F_0C_h|/|F_1C_h| \tag{4}$$

must be chosen according to the relationship $$\tan i_h = \frac{M}{M-1}\tan i_p. \tag{5}$$

If this condition is satisfied, there will be negligible depolarization caused by the two reflectors 10 and 12 and, therefore, the antenna aperture will have essentially the same polarization distribution as the aperture of feedhorn 14.

Having thus reproduced accurately both amplitude and polarization over the antenna aperture, excellent performance in polarization and side-lobes will be obtained using a properly designed feed, as is well-known in the art. Since the far-field pattern appears in the vicinity of focal point $F_1$ in FIG. 1, side-lobes can be reduced to some extent by spatial filtering as described, for example, in U.S. Pat. No. 4,259,674 issued to C. Dragone et al on Mar. 31, 1981.

Figure 2:
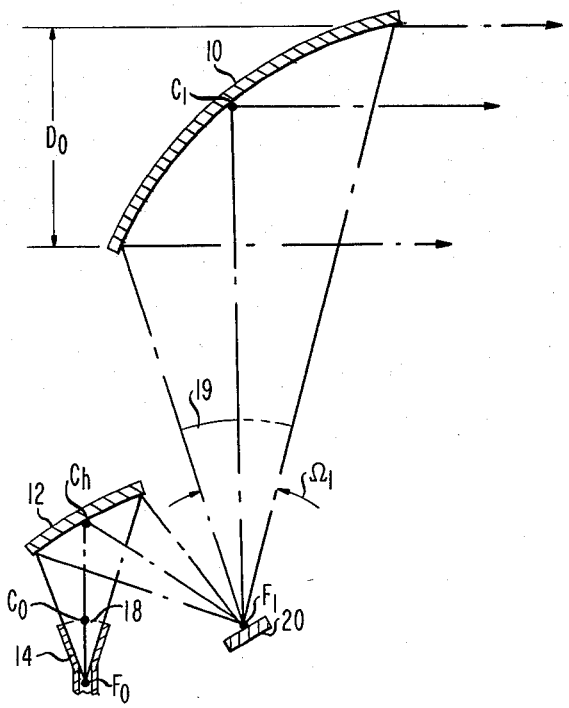
FIG. 2 illustrates a compact antenna arrangement with a vertical feed axis in accordance with the present invention, which is obtained by using a small subreflector at the focal point $F_1$ of the main reflector in FIG. 1.

If the field distribution over a plane through focal point $F_1$ is considered, it is found that the field is confined to the immediate vicinity of focal point $F_1$. For a circular aperture, for instance, the diameter w of the illuminated area corresponding to the main lobe is given approximately by the relationship $$w\approx 2.44(\lambda/D)\ |C_1F_1|, \tag{6}$$

where $\lambda$ is the wavelength of the signal being transmitted by feedhorn 14. Thus, a small flat subreflector 20 can be placed at focal point $F_1$ in FIG. 1 so as to obtain a more compact arrangement, as shown in FIG. 2. By properly choosing the angle of incidence on flat subreflector 20, the feed axis can be made orthogonal to the antenna beam as required for terrestrial radio systems.

In the arrangements of FIGS. 1 and 2, the center point $C_0$ of the feedhorn aperture and the center point on the main reflector aperture are conjugate points as required by Equation (1). This condition implies that the field distribution in the vicinity of point $C_1$ is the image of the field distribution in the vicinity of point $C_0$. Such condition, however, does not insure necessarily efficient illumination of main reflector 10 far from the center $C_1$, and this is a problem when the aperture of main reflector 10 is large. Because of this problem, appreciable spill-over can occur over part of the required field of view in a scanning beam antenna where the feed is realized using an array of feedhorns.

In accordance with the present invention, spill-over can be substantially reduced by properly orienting the plane or surface $\Sigma_0$ of the feedhorn or array and the plane or surface $\Sigma_1$ of the aperture of the main reflector 10. The required orientations are given hereinafter by equation (9). Thus far the present invention involves the use of (1) a feedhorn 14 with the aperture illuminated by a spherical wavefront 18 originating from a focal point or apex point $F_0$, (2) an ellipsoid subreflector 12 having foci $F_0$ and $F_1$, or an equivalent arrangement of several ellipsoid and/or hyperboloid subreflectors arranged so that a spherical wavefront 18 from focal point $F_0$ is transformed, according to the laws of geometric optics, into a spherical wavefront 19 from focal point $F_1$, and (3) main reflector 10 is derived from a paraboloid with a focus at point $F_1$.

Figure 3:
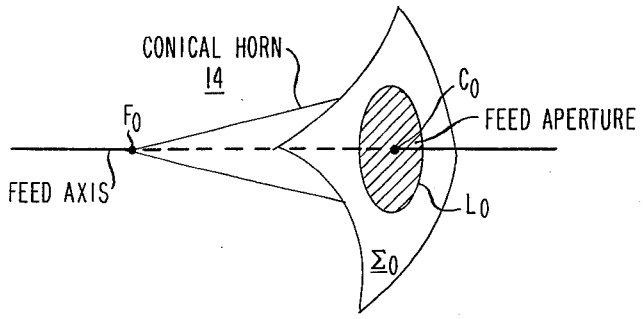
FIG. 3 illustrates a conical feedhorn with an apex $F_0$ and a directrix $L_0$.

As shown in FIG. 3, the feedhorn 14 has an axis which passes through the center $C_0$ of the feed aperture which in general will lie on a curved surface $\Sigma_0$. The region of surface $\Sigma_0$ corresponding to the feedhorn aperture is defined by a closed curve $L_0$. It is assumed that only the region inside curve $L_0$ is illuminated by the spherical wavefront 18 emanating from apex point $F_0$. This can be accomplished, for example, by using a conical feedhorn with an apex $F_0$ and a directrix $L_0$ shown in FIG. 3.

Figure 4:
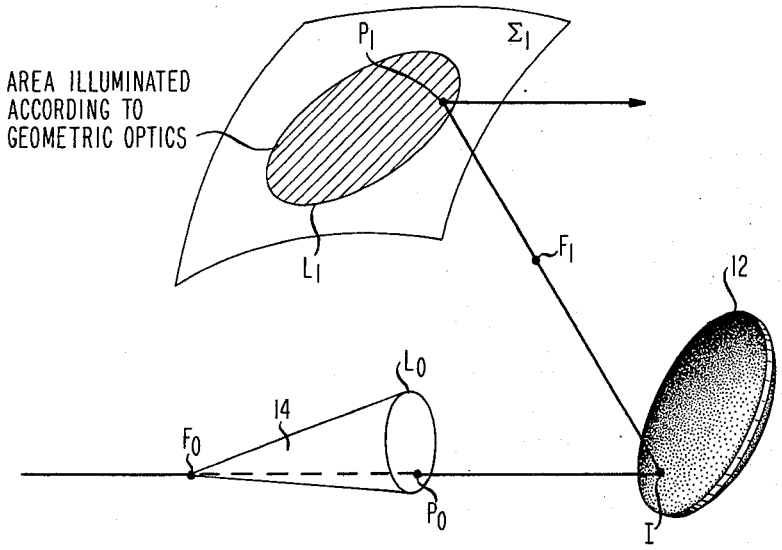
FIG. 4 illustrates the use of an imaging subreflector combined with a conical feedhorn of FIG. 3 for illuminating efficiently a main reflector.

The main reflector aperture will in general lie on a curved surface $\Sigma_1$. Hereinafter, $L_1$ will be assumed to be the closed curve of $\Sigma_1$ corresponding to the rim of main reflector 10. If the frequency of operation is sufficiently high, then the main reflector illumination can be determined using the laws of geometric optics as illustrated in FIG. 4. There, for each point $P_0$ on surface $\Sigma_0$, the corresponding ray $F_0P_0$ determines, after reflection at point I on subreflector 12, a corresponding point $P_1$ on the main reflector aperture. If $L_1$ is the curve of $\Sigma_1$ which corresponds to the curve $L_0$, then, according to the laws of geometric optics, only the region inside curve $L_1$ is illuminated by the wavefront reflected by ellipsoid subreflector 12. Thus, for efficient illumination of main reflector 10, the rim of main reflector 10 must coincide with curve $L_1$. However, if the surface $\Sigma_1$ is chosen arbitrarily, the illumination of $\Sigma_1$ will be confined inside $L_1$ only at high frequencies, since for an arbitrary location of $\Sigma_1$ the laws of geometric optics apply only at high frequencies. Thus, in addition to the above condition, it is required that the two surfaces $\Sigma_1$ and $\Sigma_0$ be conjugate surfaces so that corresponding points $P_1$ and $P_0$ are conjugate points satisfying the lens equation (7) given hereinafter. This requirement is needed because of diffraction, causing the illumination of $\Sigma_1$ to be given accurately by the laws of geometric optics only if $\Sigma_0$ and $\Sigma_1$ are conjugate surfaces. If this condition is satisfied, the illumination of surface $\Sigma_1$ will be confined to essentially the region inside $L_1$, and it will be given to a good approximation of the laws of geometric optics, even in the presence of diffraction taking place between the subreflector 12 and surface $\Sigma_0$ or $\Sigma_1$.

In order that the two surfaces $\Sigma_0$ and $\Sigma_1$ be conjugate surfaces, the point $P_1$ in FIG. 4 must be the image of point $P_0$. Thus the distances from the ellipsoid subreflector 12 must satisfy the lens equation $$(1/|P_1I|)+(1/|P_0I|)=1/f \tag{7}$$

where f is the focal length given by $$1/f=(1/|F_0I|)+(1/|F_1I|)\,. \tag{8}$$

Figure 5:
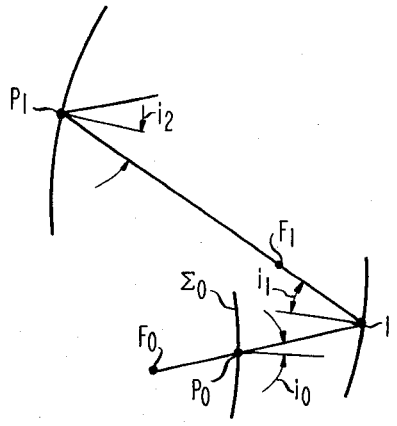
FIG. 5 illustrates an off center ray diagram for the arrangement of FIG. 1 to show the relationship of angles of incidence and conjugate points.

From the ray diagram of FIG. 5, it can be shown using Equations (7), (8) that the angle $i_2$ between the ray through point $P_1$ and the normal to conjugate surface $\Sigma_1$ is related to the corresponding angle $i_0$ between the ray through point $P_0$ and the normal to conjugate surface $\Sigma_0$ by the expression $$\tan i_0 = \left[\frac{p_0}{l_0} + M_0\frac{l_0 - p_0}{l_0}\right]\tan i_2 + 2\tan i_1\left[1 - M_0\frac{l_0 - p_0}{l_0}\right] \tag{9}$$

where $$p_0=|F_0P_0|,\ l_0=|F_0I|,\ M_0=-|F_0I|/|F_1I|, \tag{10}$$

assuming the normals to surfaces $\Sigma_0$ and $\Sigma_1$ are in the plane of the ray $P_0IP_1$.

As described hereinbefore, when the two conjugate surfaces $\Sigma_0$ and $\Sigma_1$ satisfy the lens equation (7), the illumination of the surface $\Sigma_1$ has the basic property that it can be determined to a very good approximation using the laws of geometric optics, even when these laws do not apply in the regions between the imaging subreflector 12 and the two surfaces $\Sigma_0$ and $\Sigma_1$. Thus, only the region of surface $\Sigma_1$ which is inside curve $L_1$, which is the image of curve $L_0$, is illuminated by a wavefront reflected by ellipsoid subreflector 12. Another property is that the illumination is essentially frequency-independent, and it is the illumination of a spherical wavefront 19 emanating from focal point $F_1$. Thus, if the rim of the paraboloid main reflector 10 coincides with the image $L_1$ of curve $L_0$, all of the incident power will be intercepted by main reflector 10 without spill-over.

If the edge defined by curve $L_1$ of main reflector 12 is specified, then using equation (7) the edge $L_0$ of the aperture of feedhorn 14 can be determined. However, for most applications, the surface $\Sigma_0$ can be approximated by a plane. More precisely, consider FIG. 6 as showing the antenna plane of symmetry, and let points $A_0$ and $B_0$ be the two points determined by the edge of $L_0$ of feedhorn 14 in this plane. Then surface $\Sigma_0$ can be approximated by drawing, through these two points, a plane orthogonal to the symmetry plane. Similarly, surface $\Sigma_1$ can be approximated by drawing a plane through the images $A_1$ and $B_1$ of points $A_0$ and $B_0$, respectively, as shown in FIG. 6.

Figure 6:
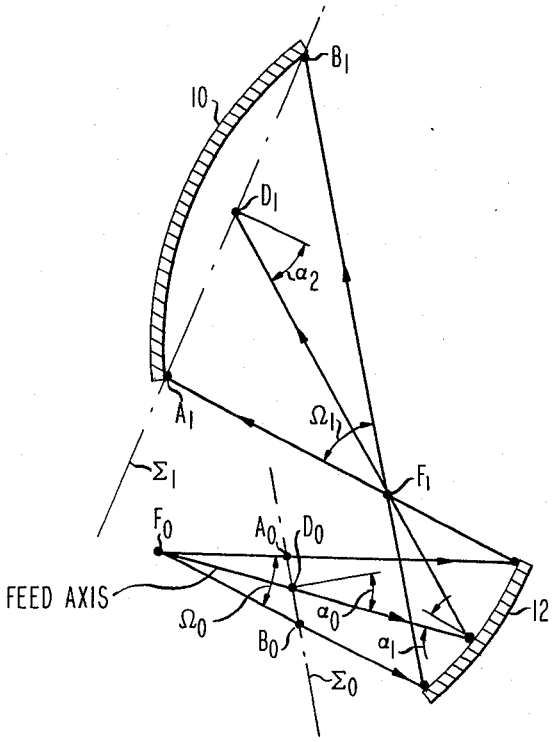
FIG. 6 illustrates the arrangement of FIG. 1 in accordance with the present invention to substantially reduce spill-over at the main reflector.

In FIG. 6, the principal ray, corresponding to the feed axis, intercepts the plane $\Sigma_0$ at point $D_0$ and, after reflection from subreflector 12, it intercepts the plane $\Sigma_1$ at point $D_1$. Since point $D_1$ is approximately the image of point $D_0$, the two angles $\alpha_0$ and $\alpha_2$, which specify the orientations of planes $\Sigma_0$ and $\Sigma_1$ in FIG. 6 satisfy equation (9) with $i_0$, $i_1$, and $i_2$ of FIG. 5 being replaced by $\alpha_0$, $\alpha_1$, and $\alpha_2$, respectively, in FIG. 6. It is known that, in general, the polarization lines obtained after reflection by the main reflector 10 in FIG. 6 differ from the polarization lines of the aperture of feedhorn 14. To minimize this difference, the angles $\alpha_1$ and $\alpha_2$ should be chosen according to Equation (5) with $i_h \approx \alpha_1$, $i_p \approx \alpha_2$ and $M \approx M_0$. This gives $$\tan\alpha_1(M_0-1)=M_0\tan\alpha_2. \tag{11}$$

The angles $\alpha_0$, $\alpha_1$, and $\alpha_2$ can always be chosen so that both conditions expressed in equations (9) and (11) are satisfied. If the antenna has a circular aperture as defined by the projection of curve $L_1$ in the direction of the paraboloid main reflector's axis, then the feed can be realized using a conical feedhorn 14 with an apex at focal point $F_0$ and with circular cross-sections provided the angles $\alpha_1$ and $\alpha_2$ satisfy equation (11).

It is to be understood that the above-described embodiments are simply illustrative of the principles of the invention. Various other modifications and changes may be made by those skilled in the art which will embody the principles of the invention and fall within the spirit and scope thereof. For example, the ellipsoid subreflector 12 could be replaced by several ellipsoid and/or hyperboloid subreflectors in the arrangement in FIGS. 1 and 2 which transform the spherical wavefront 18 emanating from apex point $F_0$ to a spherical wavefront 19 emanating from the focal point $F_1$ of main reflector 10.

What is claimed is:

1. An antenna arrangement capable of obtaining a substantially frequency independent field distribution over a large aperture, the antenna arrangement comprising:

a main parabolic reflector (10) comprising a focal point ($F_1$) and a predetermined aperture (D) and capable of converting a spherical wavefront centered at the focal point into a planar wavefront at the aperture; and a feed (14) comprising a predetermined aperture and capable of launching a spherical wavefront (18) having a predetermined apex ($F_0$)

characterized in that the antenna arrangement further comprises:

subreflecting means (12, 20) comprising a first focal point ($F_1$) disposed confocally with the focal point of the main parabolic reflector and a separate second focal point ($F_0$) along a feed axis of the subreflecting means and capable of transforming a spherical wavefront at said separate second focal point into a spherical wavefront at said first focal point; and the feed is disposed with the apex of the spherical wavefront capable of being launched therefrom located at the second focal point of the subreflecting means and an aperture surface of the feed is disposed at an image surface of the main reflector, with the image of the main reflector being substantially centered on the aperture of the feed and where each separate image point on the image surface is derived from a series of rays emanating spherically outward in slightly different directions from a separate associated point on the reflecting surface of the main reflector which rays, after being reflected by the subreflecting means, will recombine at the separate image point.

2. An antenna arrangement in accordance with claim 1 characterized in that said subreflecting means is an ellipsoid subreflector (12).

3. An antenna arrangement in accordance with claim 1 characterized in that said subreflecting means comprises an ellipsoid subreflector (12) having a first and second focal point disposed on the first and second focal point, respectively, of the subreflecting means; and a flat subreflector (20) disposed at the first focal point of the subreflecting means.

4. An antenna arrangement according to claim 1 characterized in that the feed comprises a small horn.

5. An antenna arrangement in accordance with claim 1, 2, 3 or 4 characterized in that the image of the edge of the main parabolic reflector corresponds to the edge of the aperture of the feed.

* * * * *